US005139283A

United States Patent [19]

Dow et al.

[11] Patent Number: 5,139,283

[45] Date of Patent: Aug. 18, 1992

[54] ADJUSTABLE AND FOLDABLE SKI POLE

[76] Inventors: Robert L. Dow, 73 Treetop Cir., Nanuet, N.Y. 10954; Philip S. Kornblum, 29 Oakwood Cir., Roslyn, N.Y. 11576; Jay S. Lief, 28 Raycliff Dr., Woodstock, N.Y. 12498

[21] Appl. No.: 633,374

[22] Filed: Dec. 21, 1990

[51] Int. Cl.[5] ..... A63C 11/22

[52] U.S. Cl. ..... 280/819; 135/72; 135/74; 280/821; 280/823; 280/824; 403/162

[58] Field of Search ..... 280/819, 821, 823, 824; 403/109, 119, 104, 162; 135/65, 70, 72, 74, 75

[56] References Cited

U.S. PATENT DOCUMENTS

| | | | |
|---|---|---|---|
| 2,275,330 | 3/1942 | Tveten | 280/823 |
| 2,289,818 | 7/1942 | Winner et al. | 280/823 |
| 2,494,878 | 1/1950 | Jensen | 280/823 |
| 2,818,290 | 12/1957 | Harocopo | 280/823 |
| 3,655,297 | 4/1972 | Bolen, Jr. et al. | 135/74 |
| 3,712,652 | 1/1973 | Uilkema | 280/823 |
| 3,722,903 | 3/1973 | Jones | 280/823 |
| 3,730,544 | 5/1973 | Hyman | 135/65 |
| 4,175,683 | 11/1979 | Shields | 280/824 |
| 4,288,102 | 9/1981 | Ramer | 280/823 |
| 4,332,399 | 6/1982 | Kepple | 280/819 |
| 4,424,987 | 1/1984 | Ryder | 280/823 |
| 4,596,405 | 6/1986 | Jones | 280/823 |

FOREIGN PATENT DOCUMENTS

| | | | |
|---|---|---|---|
| 2558940 | 7/1977 | Fed. Rep. of Germany | 280/819 |
| 636530 | 6/1983 | Switzerland | 280/819 |

*Primary Examiner*—Eric D. Culbreth
*Attorney, Agent, or Firm*—Paul J. Sutton

[57] ABSTRACT

This invention discloses an adjustable and foldable ski pole which comprises two pole sections hinged together to be foldable into a uniquely convenient compact structure that can be carried safely and easily and can be easily stored in a car, boot bag or its own nylon bag while being adjustable for users of different heights. The ski pole has an especially robust construction to be durable and suitable for professional use. Further benefits are provided for retailers and ski rental agencies.

5 Claims, 2 Drawing Sheets

FIG. 1
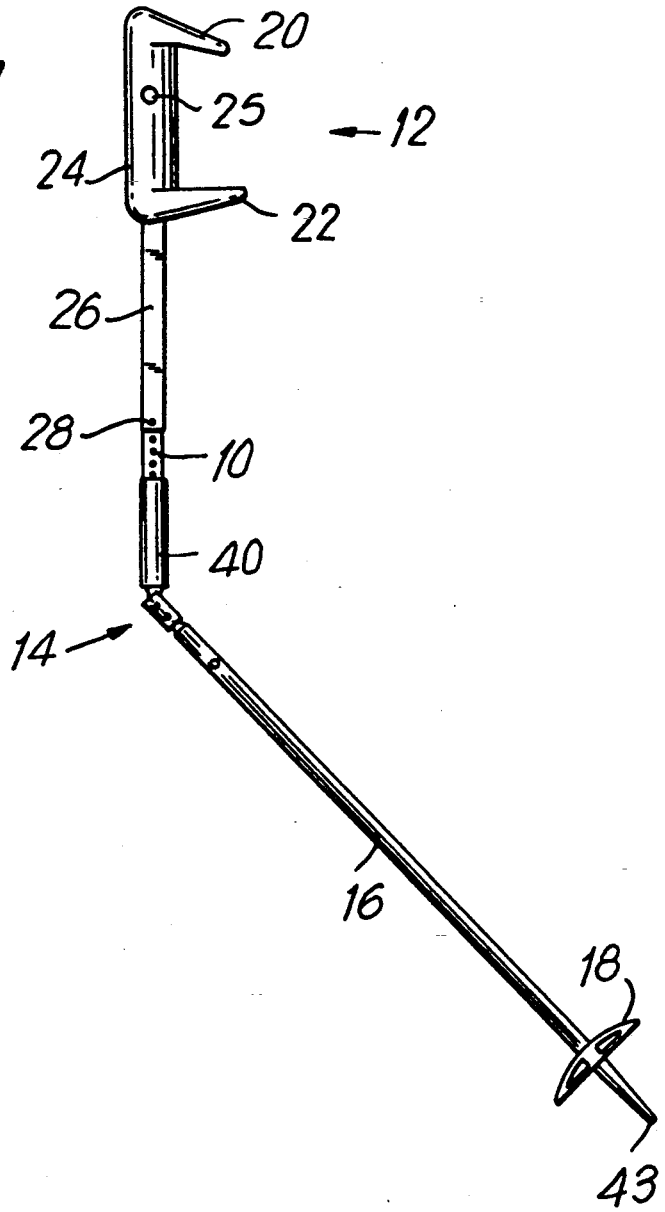
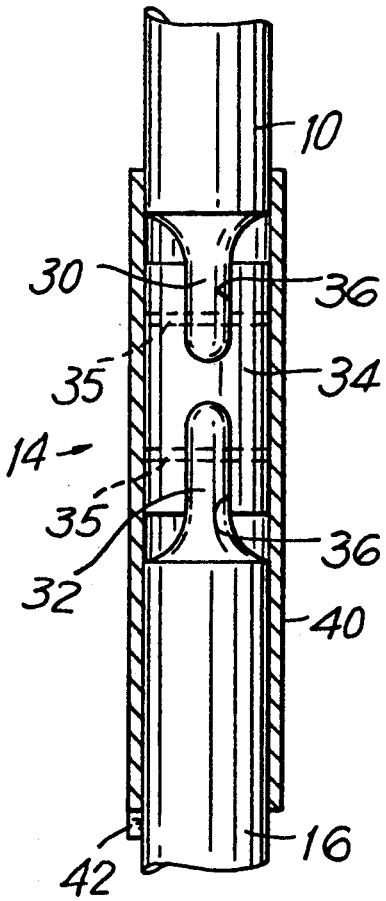
FIG. 2

ADJUSTABLE AND FOLDABLE SKI POLE

BACKGROUND OF THE INVENTION

1. Field of the Invention

This invention relates to ski poles. More particularly, it relates to collapsible ski poles that can be shortened when out of use, for more convenient storage or shipping.

2. The Prior Art

Ski poles customarily have a hand grip at one end and a laterally extending snow basket at the other end. The hand grip usually has various lateral structures that can provide means to hold the ski pole securely and sometimes include a support or hand guard to take downward pressure from the skier's hand. These gripping structures also usually include a wrist strap.

It is desirable for a ski pole to be both collapsible for storage and shipping, and adjustable in length to enable skiers of different heights, for example, the members of a family, to share the same poles. Such adjustability enables the pole to "grow" with a child, and can reduce stocking requirements for retailers and rental sites: there is no need to stock many different sizes. Adjustability is thus a valuable and important characteristic, and as the prior art shows, there has been a long-felt need for, and many attempts have been made to provide, a satisfactory adjustable ski pole.

Telescopic ski poles are known, for example from U.S. Pat. Nos. 2,275,330; 2,289,818; 2,494,878; 3,712,652; 3,722,903; 3,730,544; 4,288,102; 4,424,987 and 4,596,405. While telescopic means are effective in rendering the out-of-use pole more compact, they suffer important drawbacks and are inconvenient. An out-of-use telescoping pole, such as those shown in the above-referenced patents, has encumbrances at both ends, in the form of the hand grip at one end and the basket at the other end. Alternatively, those constructions where the sections are separable, suffer the awkwardness of providing multiple freely movable sections that may be hard to control, especially with one hand, and quite difficult to store.

Several of the above-referenced disclosures show a telescopic ski pole that is adjustable to a limited number of locked or located positions to enable a skier to choose a comfortable pole length. Indeed, it can be considered to be a customary teaching in the art to use a telescopic mechanism to provide both collapsibility and adjustability.

What is lacking from all the prior art proposals that are known to the applicant (who went to the expense of commissioning a professionally conducted search for the purpose) is a full appreciation of the demands placed on its construction by normal use of the ski pole. In use a ski pole is often pounded into snow or ice, and may well strike hidden rocks quite violently, subjecting the pole to very substantial stresses which can soon destroy complex and delicate structures.

Telescopic mechanisms respond poorly to such treatment, their tubes are liable to deform, their latching or locking components are liable to strip, producing a sloppy, potentially dangerous mechanism. These problems are exacerbated by structures which tend to divert downward pressures laterally. Telescopic ski poles are thus not very durable and their popularity is limited.

In an unrelated art, U.S. Pat. No. 3,655,297 to Bolen Jr. et al discloses a foldable paddle with a hinge assembly at its mid-point. The paddle is not adjustable so that its structure does not help meet the objectives of the present invention. Furthermore, the complex hinge structure of Bolen Jr. et al with its thin, plate-like links does not help overcome the drawbacks of telescopic ski poles because it is designed to resist bending stress in the direction of paddling, not downward or lengthwise stresses. In response to sudden, heavy downward loads, the Bolen hinge structure with its plate-like links is subject to flexure and weakening. The use of such a structure for ski poles is plainly contra-indicated as providing no apparent benefit and being impracticable.

U.S. Pat. No. 3,730,544 to Hyman discloses a collapsible and foldable ski pole formed in three interfitting sections strung or tethered together by a flexible cable. When collapsed, the folded ski pole of Hyman is also encumbered by hand grip structures at one end and a snow basket at the other and is thus inconvenient. Nor is Hyman adjustable. Hyman thus cannot meet the objectives of the present invention.

U.S. Pat. No. 4,332,399 to Kepple discloses a ski pole having separable sections connected by a coil spring which provides limited lateral flexure of the assembled pole, under stress. The out-of-use pole suffers the drawback of the separable telescoping poles, namely multiple freely movable sections that are hard to control and stow. How successfully it transmits downward loads is not clear and will depend upon the particular spring construction. In any event, Kepple is not adjustable and therefore lacks the flexibility of use which constitutes one of the objectives of the present invention.

BRIEF DESCRIPTION OF THE INVENTION

It is one object of the present invention to provide a ski pole which is adjustable and durable and can be collapsed to a convenient form that can easily be handled, stored and shipped.

It is another object of this invention to provide a ski pole which can be collapsed to a convenient form that can be stored compactly in a car, either in the interior or the trunk, or can be easily inserted in a bag.

It is yet another object of the invention to provide a collapsible ski pole that has a collapsed configuration which is neat and safe.

Another object is to provide a collapsible ski pole that can be adjusted for length while collapsed.

It is a further object of this invention to provide a ski pole which provides for direct downward application of loads to the ski basket, without significant lateral components of those loads being developed in normal use.

It is a still further object of this invention to provide a ski pole which transmits downward loads in a substantially rectilinear manner.

Another object of this invention is to provide a ski pole which is modular, having replaceable components.

Accordingly, the present invention provides an adjustable and foldable ski pole comprising:

upper and lower pole sections;

hand grip means on the upper pole section which hand grip means includes laterally extending load-transmitting structures;

a laterally extending snow basket on the lower pole section;

hinge means connecting the pole sections which hinge means is adapted and disposed to transmit loads between the sections in an opened, ready-for-use configuration of the ski pole with the pole sections in end-to-end relationship; and adjustment means to change the length of the ski pole;

whereby said hinge means enables the pole to be folded into a configuration where the upper and lower pole sections are disposed side-by-side with the hinge means at one end of the folded pole and the basket and hand grip means at the other.

Said hinge means provides the requisite collapsibility, allowing the ski pole of this invention to be folded. By providing a ski pole with separate collapsing and adjusting means, the pole can be designed with a simple, robust structure that is sufficiently durable for frequent, or professional use.

A preferred embodiment includes a slidable cover for the hinge means which cover can be in the form of a sleeve movable along one of the sections, preferably the upper. In a closed position, this cover is preferably capable of constraining the pole sections into longitudinal alignment. The cover can extend across the hinge and conceal it completely.

Further objects of the present invention and its features will suggest themselves to those skilled in the art upon a reading of the present specification, together with the drawings annexed hereto wherein, throughout the several views, similar reference characters denote similar elements.

BRIEF DESCRIPTION OF THE DRAWINGS

FIG. 1 of the drawings is a front elevational view of an embodiment of a ski pole according to the invention, in a partially folded condition;

FIG. 2 is an enlarged side elevational view of a hinge assembly being a component of the ski pole of FIG. 1, with a slidable cover broken away to reveal the structure of the hinge, in an extended ready-for-use position;

DETAILED DESCRIPTION OF THE INVENTION

Figure 3:
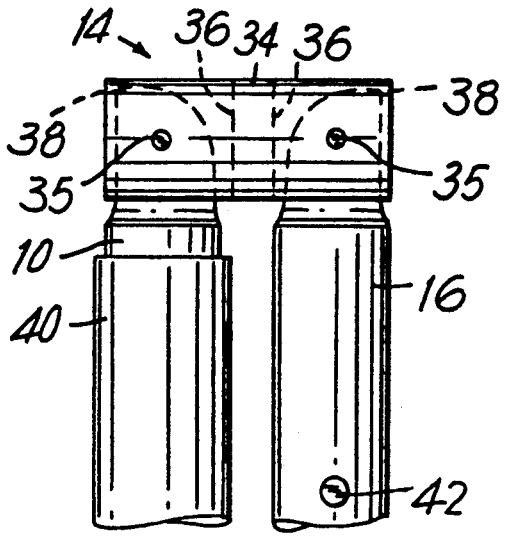
FIG. 3 is an enlarged front elevational view of the hinge assembly of FIG. 1, in a folded position with the cover open.

Referring to the drawings, the ski pole shown comprises an upper pole section 10 carrying a hand grip assembly 12 at its upper end and attached to a hinge assembly 14 at its lower end. A lower pole section 16 depends from the hinge assembly 14 and carries towards its lower end a generally circular snow basket 18. The pole sections 10 and 16 are preferably tubular and formed of a strong lightweight metal alloy such as an aluminum, magnesium or titanium alloy. Carbon fiber is another possible material.

The hand grip assembly 12 comprises an upper guard 20, a lower guard 22 and finger grips 24 so that the pole can be held firmly and moved up or down with as much strength as the skier cares to exert. A hole 25 enables the ski pole to be secured by a cable lock. Typically, the finger grips 24, and perhaps some other parts of the hand grip assembly 12, are formed of an elastomeric material and they can be removably attached to the assembly 12 for replaceability and modularity.

The hand grip assembly 12 further comprises a downward extension 26 which is telescopically slidable on the upper pole section 10 and lockable thereto at a selected number of positions to give the ski pole lengthwise adjustability. Suitable locking means comprises an internally threaded hollow pin 28 passing through openings in the extension 26 and the upper pole section 10 and secured by a screw (not shown). The hollow pin 28 and its securing screw can be relatively substantial to provide a solid lock between the downward extension 26 of the hand grip assembly 12 and the upper pole section 10 so as to bear and transmit heavy loads without mechanical damage. The upper pole section 10 is preferably provided with a number of vertically spaced openings to receive the hollow pin 28 in an upward portion of the upper pole section 10 concealed within the downward extension 26. Plainly, other adjustable and lockable means can be used, so long as they are secure and provide a relatively solid construction with good load-transmission characteristics.

The upward portion of the upper pole section 10 and the downward extension 26 of the hand grip assembly 12 can both have a rectangular or otherwise shaped section to hold their respective pin-receiving openings in lateral alignment. The lower portion of the upper pole section 10 has a circular section for strength, and as shown in FIGS. 2 and 3 terminates in a hinge lobe 30. The upper end of the lower pole section 16 has a similar hinge lobe 32 and these hinge lobes are pivotally secured to a plug-like, cylindrical hinge body 34 by substantial hinge pins 35. The hinge body 34 is provided at each end with a transverse slot 36 to receive the hinge lobes 30 and 32. Each hinge lobe 30 and 32 has a profile which is part-circular on one side and squared-off on the other to offer locking abutments 38. The hinge lobes 30 and 32 are mounted in the hinge body 34 in opposed manner to provide a one-way hinge mechanism. This one-way hinge mechanism permits the upper and lower pole sections 10 and 16 to be folded into a side-by side relationship, as indicated in FIG. 3, but prevents their being swung much past their end-to-end aligned, or vertical position, by engagement of the locking abutments 38 in the slots 36.

The hinge assembly 14 is of robust construction to transmit lengthwise loads effectively and to this end the lobes 30 and 32 and the hinge body 34 are preferably of solid construction, for example, molded and machined from a substantially rigid plastic, but sheet-metal constructions that are adequately robust will occur to those skilled in the art. In this vein, it is the sides of the hinge body 34 that should be sturdy and substantial to transmit loads between the hinge pins 35. Similarly, the hinge pins 35 should be reasonably substantial and fit closely within openings in the lobes 30 and 32 and the hinge body 34 to avoid lost motion and transmit loads.

A rigid tubular cover 40 is slidably carried on the upper pole section 10 and can pass over the hinge assembly 14 when the ski pole is unfolded. A stop 42 on the lower pole section 16 prevents the cover 40 moving down past the hinge assembly 14. The cover 40 is preferably a snug sliding fit on the pole sections 10 and 16 and, when closed, holds the sections 10 and 16 in end-to-end alignment, constraining them against pivotal movement. If desired a cover latch can be provided which is locked and unlocked by twisting the cover 40.

Although shown as integral formations at the ends of the pole sections 10 and 16, the hinge lobes 30 and 32 are preferably manufactured as separate, solid, machined or molded elements that plug into the pole sections 10 and 16 and are secured there by pins, fasteners or swaging. Alternatively, the lobes 30 and 32 could screw into the pole sections 10 and 16.

The snow basket 18 is securely attached to the lower pole section 16 at its lower end and may be removably attached to provide modularity, for example by means of a long threaded rod or bolt having a head 43 serving as a hard tip for the ski pole.

Figure 4:
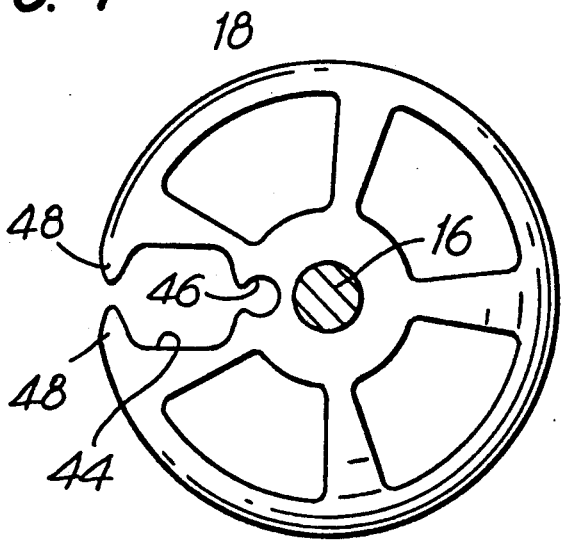
FIG. 4 is a top plan view of a modified snow basket for the ski pole of FIG. 1.

Referring to the modified snow basket 18 shown in FIG. 4, a larger cutout 44 can be shaped to accommodate the hand grip assembly 12 while a smaller cutout 46, opening off the larger cutout 44 can be shaped to be a snap fit around the downward extension 26 of the hand grip assembly 12. The cutout 44 can be flanked by a pair of fingers 48 which have limited flexibility to admit, or release, the hand grip assembly 12 and also to hold it. Preferably the fingers 48 flex downwardly but not upwardly and have tapered inner and outer surfaces to enhance this flexure. The fingers 48 may be flattened on their undersides for snow engagement and thus serve the dual purpose of holding the hand grip assembly 12 when the ski pole is folded and facilitating the normal, snow-engaging use of the snow basket.

To employ the unique interlocking features of this modified snow basket 18, the hand grip assembly 12 and the one-way hinge assembly 14 are disposed with an opposite orientation to that shown in FIG. 1, so that the snow basket 18 can fold against the front, (left-hand side as shown in FIG. 1) face of the hand grip assembly 12 and can snap thereon, the basket 18 being disposed to position the cutouts 44 and 46 accordingly. With the ski pole adjusted to a greater height, the smaller cutout 46 can engage and hold the narrower downward extension 26 of the hand grip assembly 12. The snow basket 18 can be formed of any suitable material having, or formed to have, limited flexibility, for example a plastic or rubber which has limited resilience.

Although those skilled in the art will naturally appreciate that various embodiments of the ski pole of this invention can be fabricated with different dimensions, a useful preferred embodiment is adjustable over about five or six inches to a maximum height of about forty-five inches with locking positions about every inch in between. Lightweight, yet strong, tubular pole sections can be provided with a dimension of about five-eighths of an inch for the diameters of the pole sections 10 and 16 and the hinge body 34 with the length of the hinge body 34 being somewhat more than its width at about an inch and three-quarters. A length of four to five inches is comfortable and effective for the cover 40.

To use the pole, a skier can complete the unfolding of the ski pole from the position shown in FIG. 1 to a vertical position where the one-way hinge construction helps align the sections, easing the cover-closing action. The tubular cover 40 can now be slid down over the hinge assembly 14 until it engages the stop 42, and twisted to lock it, if a latch is provided.

Subject to height adjustment, the pole is now ready for skiing, during which the basket 18 may be frequently thrust into the snow, which way be wet or icy, the tip 43 may hit rocks, and the pole may have to be pulled upwardly to release it. Its construction must be able to withstand all these motions without damage, and especially must it withstand heavy longitudinal stresses from thrusting the pole into the snow or ground.

Ski poles constructed in accordance with the novel teachings of the present invention are uniquely designed to meet these requirements while also providing the advantages of adjustability and collapsibility. The several bearing surfaces across which loads are transmitted from the hand grip assembly 12 to the snow basket 18 are symmetrically disposed about a central vertical axis of the ski pole so as to minimize any lateral or twisting components of these loads, which could distort and damage the pole mechanism.

These load-bearing surfaces are: the engagement points between the adjustment pin 28 and the downward extension 26 of the hand grip assembly 12; the engagement points between the adjustment pin 28 and the upper pole section 10; and the engagement points in the hinge assembly 14. These latter bearing surface points of engagement comprise the surfaces between the pins 35 and the hinge lobes 30 and 32 and between the pins 35 and the several surfaces in the openings in the hinge body 34. Because of the simple yet ingenious construction, as downward loads are applied, these surfaces are all essentially perpendicular to the vertical axis of the ski pole and therefore do not develop lateral components of the loads.

Without undue expense, the relevant components can all be carefully engineered to close tolerances that will provide a durable adjustable and collapsible ski pole that can be used extensively without developing lost motion or slackness.

The cover 40, being adequately rigid and strong, helps reinforce the ski pole against bending under excessive stresses, such as when a skier slips or stumbles.

After skiing, ski poles according to the invention can be collapsed and folded into a convenient out-of-use position by sliding the cover 40 upwardly, after twisting it to unlock it, if necessary, and swinging the lower section 16 about the hinge assembly 14 to bring the sections 10 and 16 into a side-by-side relationship where they can easily be carried in one hand, with the hard tip 43 safely out of the way alongside the hand grip assembly 12.

The folded ski pole has many advantages. It can easily be stored in a relatively small nylon bag, and hooked on to the skier's clothes, for example the skier's pants or belt. The folded pole can also fit into a boot bag.

Importantly, the ski pole of this invention can easily be stored in a car, in the trunk or the interior thereof, or on a closet shelf. The compact end provided by the hinge assembly 14, and the fact that the basket 18 and the hand grip assembly 12 are disposed at the same end of the pole sections 10 and 16, facilitate storage.

The folded configuration is not only safer in terms of threats to other people, but obviates the risk of the pole being damaged by bending it.

The threaded hollow pin 28 and its securing screw comprise a solid, robust means for locking or latching the ski pole into a selected position of adjustment according to the particular needs or desires of the user. Other such locking means can be provided within the spirit of this invention so long as they meet the objectives of the invention. For, example, a more elaborate quick-release locking means could be provided. However, the simple, economic construction shown is quite adequate for most users, noting that because this invention provides separate adjustment and collapsing means, pole adjustment does not have to be made on the sloes with the ski pole fully extended, but can be made at home, in the ski lodge, or even in the car, with the pole collapsed or folded.

Ski poles according to the invention have particular merits for the retailer. Their folded configuration makes them easy to ship and display, while their adjustability reduces the stocking units a store need carry. Modularity can serve this end by providing customers with a wide selection of styles, qualities or sizes made up from interchangeable grips, baskets or hand grip assemblies.

Slopeside ski rental agencies can also benefit from using the ski poles of this invention. Foldability facilitates storage, of course, especially enabling the poles to be stored along with boots to be rented, in a boot bag. Adjustability is valuable: not just in reducing the number of different skis to be stocked, but in ensuring that a skier can rent a pole of the correct length, an important safety consideration.

With regard to adjustability, load-transmitting capability is important and speed of adjustment is less so, because adjustments will usually be made away form the slopes, indoors. Thus, the simple, sturdy pin 28 can provide a better locking means than more complex, but delicate devices.

It is, however, important for the ski pole to be capable of being quickly unfolded and assembled to its extended configuration, so that it can be assembled on a cold mountain slope by a skier wearing gloves, without needing great finger strength or dexterity, which more elaborate devices may require. The simple hinge and sliding cover design of this invention is well adapted to meet this requirement.

The modified ski basket shown in FIG. 4 enhances the folded configuration of the ski pole by rendering it more compact and by holding the sections together so that they do not inadvertently and inconveniently swing apart.

The embodiments of the invention disclosed and described in the present specification, drawings and claims are presented merely as examples of the invention. Other embodiments, forms and modifications thereof will suggest themselves from a reading thereof and are contemplated as coming within the scope of the present invention.

What I claim is:

1. An adjustable and foldable ski pole comprising:

upper and lower pole sections;

hand grip means on the upper pole section, which hand grip means includes laterally extending load-transmitting structures;

a laterally extending snow basket on the lower pole section;

hinge means connecting the pole sections which hinge means is adapted and disposed to transmit loads between the sections in an opened, ready-for-use configuration of the ski pole with the pole sections in end-to-end relationship; and adjustment means to change the length of the ski pole; whereby said hinge means enables the pole to be folded into a configuration wherein the upper and lower pole sections are disposed side-by-side with the hinge means at one end of the folded pole and the basket and hand grip means at the other, wherein said basket has an opening to accommodate said hand grip means to provide a more compact folded configuration of the ski pole, and wherein the basket has a further, smaller opening to accommodate a narrower structure of the ski pole in a different position of adjustment.

2. An adjustable and foldable ski pole comprising:

upper and lower pole sections;

hand grip means on the upper pole section, which hand grip means includes a vertical section having finger grip indentations on its surface, and a pair of laterally extending load-transmitting structures respectively extending from said vertical section above and below said finger grip indentations;

a laterally extending snow basket on the lower pole section;

hinge means connecting the pole sections which hinge means is adapted and disposed to transmit loads between the sections in an opened, ready-for-use configuration of the ski pole with the pole sections in end-to-end relationship; and adjustment means to change the length of the ski pole; whereby said hinge means enables the pole to be folded into a configuration wherein the upper and lower pole sections are disposed side-by-side with the hinge means at one end of the folded pole and the basket and hand grip means at the other wherein the lower potion of said upper pole section terminates in a first hinge lobe integral thereto, and the upper portion of said lower pole section terminates in a second hinge hole integral thereto, and said hinge means comprises a body having respective first and second slots and means for pivotally securing said first and second hinge lobes within said first and second slots.

3. A ski pole according to claim 2 wherein said means for pivotally securing said hinge lobes comprises a plurality of hinge pins.

4. A ski pole according to claim 2 wherein said first and second hinge lobes each comprise locking abutments which allow said pole to be folded into said configuration wherein the upper and lower pole sections are disposed side-by-side but prevent said upper and lower sections being swung in an opposite direction substantially past an end-to-end aligned or vertical position.

5. A ski pole according to claim 4 wherein said means for pivotally securing said hinge lobes comprises a plurality of hinge pins.

* * * * *

UNITED STATES PATENT OFFICE

CERTIFICATE OF CORRECTION

PATENT NO. : 5,139,283

DATED : August 18, 1992

INVENTOR(S) : Robert L. Dow et al.

It is certified that error appears in the above-identified patent and that said Letters Patent is hereby corrected as shown below:

Col. 8, Claim 2, line 25, after "hinge", delete "hole" and substitute therefor --lobe--.

Signed and Sealed this

Twenty-eighth Day of September, 1993

Bruce Lehman

*Attest:*

BRUCE LEHMAN

*Attesting Officer*

*Commissioner of Patents and Trademarks*